US005405281A

United States Patent [19]

Sandor

[11] Patent Number: 5,405,281

[45] Date of Patent: Apr. 11, 1995

[54] TOPPLING TONE-PRODUCING TOY APPARATUS

[76] Inventor: Ralph Sandor, Ramapo Park, Oakland, N.J. 07436

[21] Appl. No.: 197,301

[22] Filed: Feb. 16, 1994

[51] Int. Cl.[6] ..... A63H 33/04; A63H 5/00; A63F 1/02; A63F 27/00

[52] U.S. Cl. ..... 446/2; 446/397; 273/293; 40/455; 40/906

[58] Field of Search ..... 446/2, 396, 397, 418, 446/419, 422, 487; 273/292, 293, 86 C, 237; 40/455, 906

[56] References Cited

U.S. PATENT DOCUMENTS

| | | | |
|---|---|---|---|
| 1,548,338 | 8/1925 | Smelinsky | 446/419 X |
| 1,621,784 | 3/1927 | Jenkins | 446/419 X |
| 2,315,793 | 4/1943 | Jay | 446/397 X |
| 3,315,404 | 4/1967 | Rosen | 446/2 |
| 3,791,653 | 2/1974 | Yamada | 446/404 X |
| 3,873,097 | 3/1975 | Willis | 446/404 X |
| 3,921,331 | 11/1975 | Schatz | 446/325 X |
| 4,358,274 | 11/1982 | Chase | 446/2 X |
| 5,145,178 | 9/1992 | Ropars | 446/418 X |

FOREIGN PATENT DOCUMENTS

| | | | |
|---|---|---|---|
| 2218689 | 4/1972 | Germany | 446/2 |
| 1547839 | 3/1990 | U.S.S.R. | 446/396 |

*Primary Examiner*—Robert A. Hafer
*Assistant Examiner*—D. Neal Muir

[57] ABSTRACT

A toppling tone-producing toy apparatus for producing a plurality of tones comprising a plurality of tiles, each tile having a front face, a back face, and a peripheral edge; a plurality of striker bars, each striker bar coupled to the back face of a tile; a note mechanism coupled to each tile for producing a tone when struck by a striker bar on another tile; a support mechanism for holding the tiles thereon; and a plurality of hinges, each hinge coupling the peripheral edge of each tile to the support mechanism for allowing pivotal movement of the tile, the coupling of the tiles with the support mechanism creating a generally aligned configuration where the front faces of the tiles are directionally aligned and each tile is offset from adjacent tiles by a distance less than its height such that when a tile is toppled towards an adjacent tile, its striker bar contacts the note mechanism of the adjacent tile, whereby toppling the adjacent tile, producing a tone, and creating a toppling effect that ripples through the remainder of the configuration, thus producing a plurality of tones from the note mechanisms of subsequent toppling tiles.

3 Claims, 3 Drawing Sheets

TOPPLING TONE-PRODUCING TOY APPARATUS

BACKGROUND OF THE INVENTION

1. Field of the Invention

The present invention relates to a toppling tone-producing toy apparatus and more particularly pertains a toppling tone-producing toy apparatus for producing a plurality of tones.

2. Description of the Prior Art

The use of toys is known in the prior art. More specifically, toys heretofore devised and utilized for the purpose of producing a plurality of tones are known to consist basically of familiar, expected and obvious structural configurations, notwithstanding the myriad of designs encompassed by the crowded prior art which have been developed for the fulfillment of countless objectives and requirements.

By way of example, U.S. Pat. No. 328,107 to Cheatwood discloses a wooden domino, U.S. Pat. No. 4,437,260 to Yoshida discloses a domino toppling toy, U.S. Pat. No. 4,632,664 to Manning discloses a toppling game apparatus, U.S. Pat. No. 5,016,889 to Moss discloses a game tile structure, and U.S. Pat. No. 5,083,960 to Erickson discloses a domino effect toy with a return cascade.

While these devices fulfill their respective, particular objective and requirements, the aforementioned patents do not describe a toppling tone-producing toy apparatus that produces a plurality of tones when the tiles of the toy are toppled.

In this respect, the toppling tone-producing toy apparatus according to the present invention substantially departs from the conventional concepts and designs of the prior art, and in doing so provides an apparatus primarily developed for the purpose of producing a plurality of tones.

Therefore, it can be appreciated that there exists a continuing need for new and improved toppling tone-producing toy apparatus which can be used for producing a plurality of tones. In this regard, the present invention substantially fulfills this need.

SUMMARY OF THE INVENTION

In the view of the foregoing disadvantages inherent in the known types of toys now present in the prior art, the present invention provides an improved toppling tone-producing toy apparatus. As such, the general purpose of the present invention, which will be described subsequently in greater detail, is to provide a new and improved toppling tone-producing toy apparatus and method which has all the advantages of the prior art and none of the disadvantages.

To attain this, the present invention essentially comprises, in combination: a flexible belt having an upper surface, a lower surface, and a plurality of spaced and opposed semi-circular cut-out pairs formed thereon; a plurality of rectangular tiles, each tile having an upper edge, a lower edge, a front face, and a back face; a plurality of striker bars, each striker bar coupled to the back face of a tile near the upper edge; a plurality of T-shaped note bars, each bar producing a tone when struck by a striker bar; coupling means for coupling each T-shaped note bar to a tile at a position allowing the note bar to produce a tone when struck by a striker bar on another tile; and a plurality of hinges, each hinge coupling the lower edge of each tile to the belt for allowing pivotal movement of the tile, the coupling of the tiles with the belt creating a linear configuration where the front faces of the tiles are directionally aligned and each tile is offset from adjacent tiles by a distance less than its height such that when a tile is toppled towards an adjacent tile, its striker bar contacts the note bar of the adjacent tile, whereby toppling the adjacent tile, producing a tone, and creating a toppling effect that ripples through the remainder of the configuration, thus producing a plurality of tones from the note bars of subsequent toppling tiles.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toppling tone-producing toy apparatus which has all the advantages of the prior art toys and none of the disadvantages.

It is another object of the present invention to provide a new and improved toppling tone-producing toy apparatus which may be easily and efficiently manufactured and marketed.

It is a further object of the present invention to provide a new and improved toppling tone-producing toy apparatus which is of durable and reliable construction.

An even further object of the present invention is to provide a new and improved toppling tone-producing toy apparatus which is susceptible of a low cost of manufacture with regard to both materials and labor, and which accordingly is then susceptible of low prices of sale to the consuming public, thereby making such a toppling tone-producing toy apparatus economically available to the buying public.

Still yet another object of the present invention is to provide a new and improved toppling tone-producing toy apparatus which provides in the apparatuses and methods of the prior art some of the advantages thereof, while simultaneously overcoming some of the disadvantages normally associated therewith.

Even still another object of the present invention is to provide a new and improved toppling tone-producing toy apparatus for producing a plurality of tones.

Even still another object of the present invention is to provide a new and improved toppling tone-producing toy apparatus that entertains through the toppling of tiles and the production of audible tones.

Even still another object of the present invention is to provide a new and improved toppling tone-producing toy apparatus for producing a plurality of tones that has tiles arranged in a generally aligned configuration such that toppling a tile will topple subsequent tiles, whereby producing a plurality of tones.

Even still another object of the present invention is to provide a new and improved toppling tone-producing toy apparatus that includes a plurality of different sized note bars for producing different tones.

Even still another object of the present invention is to provide a new and improved toppling tone-producing toy apparatus whose note bars can be arranged to produce a simple tune.

Even still another object of the present invention is to provide a new and improved toppling tone-producing toy apparatus that allows all tiles placed in a fallen position to be immediately reset in an upright position by merely holding the strap vertically, whereby allowing the fallen note bars to once again assume an upright position, and then placing the strap on any generally flat surface, thus enabling the toy for use.

Even still another object of the present invention is to provide a new and improved toppling tone-producing toy apparatus having a belt that may be coupled around another item, such as a birthday cake.

Lastly, it is an object of the present invention to provide a new and improved toppling tone-producing toy apparatus comprising a plurality of tiles, each tile having a front face, a back face, and a peripheral edge; a plurality of striker bars, each striker bar coupled to the back face of a tile; note means coupled to each tile for producing a tone when struck by a striker bar on another tile; support means for holding the tiles thereon; and a plurality of hinges, each hinge coupling the peripheral edge of each tile to the support means for allowing pivotal movement of the tile, the coupling of the tiles with the support means creating a generally aligned configuration where the front faces of the tiles are directionally aligned and each tile is offset from adjacent tiles by a distance less than its height such that when a tile is toppled towards an adjacent tile, its striker bar contacts the note means of the adjacent tile, whereby toppling the adjacent tile, producing a tone, and creating a toppling effect that ripples through the remainder of the configuration, thus producing a plurality of tones from the note means of subsequent toppling tiles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
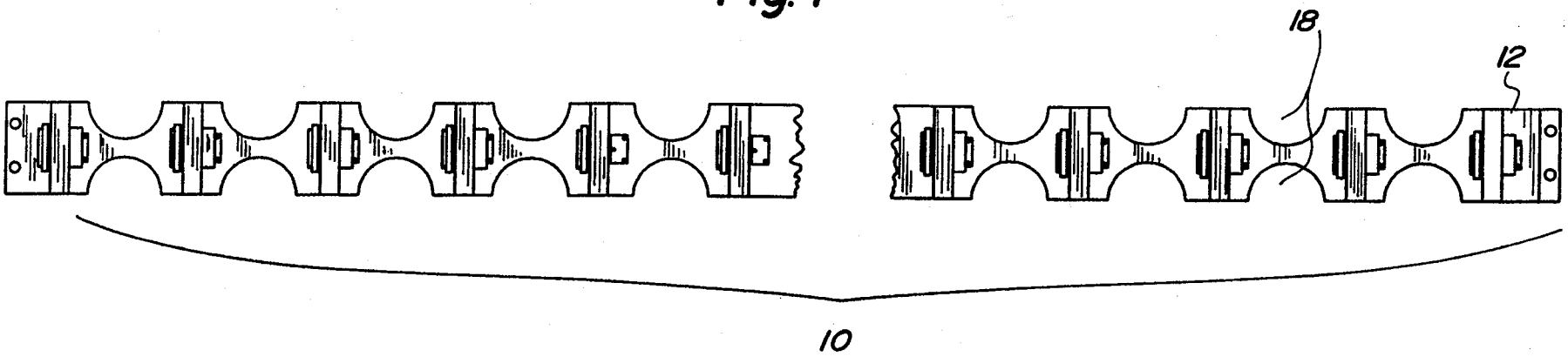
FIG. 1 is a plan view of the preferred embodiment of the toppling tone-producing toy apparatus constructed in accordance with the principles of the present invention.
Figure 2:
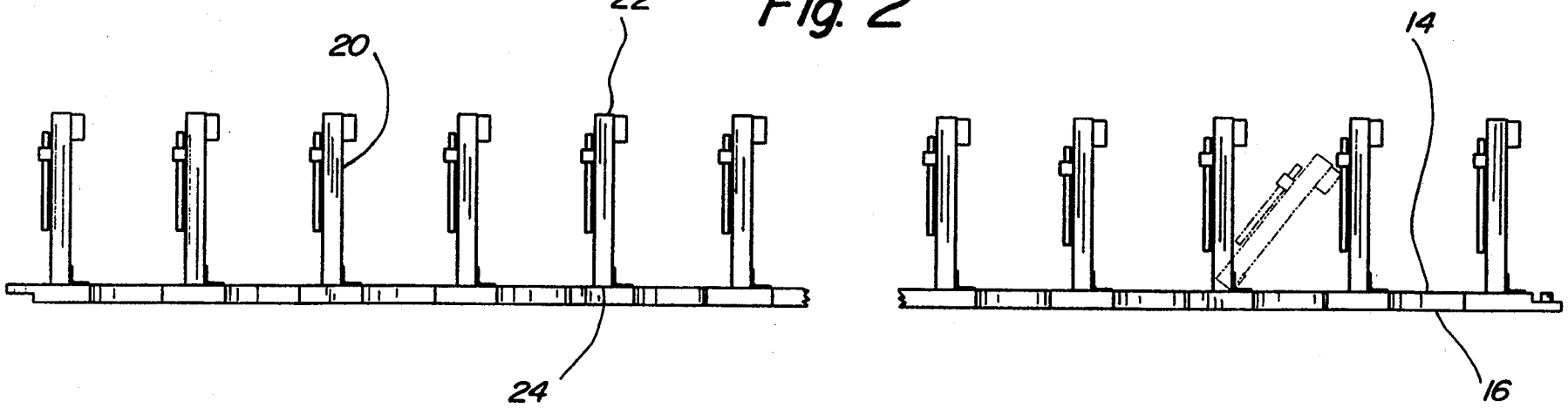
FIG. 2 is a side view of the preferred embodiment of the present invention of FIG. 1.
Figure 4:
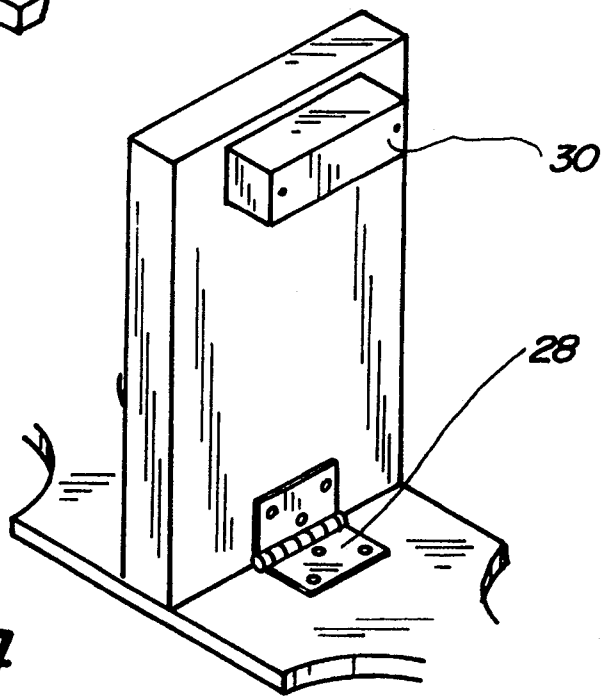
FIG. 4 is a perspective view of the coupling between a tile, striker bar, and the belt of the present invention.
Figure 3:
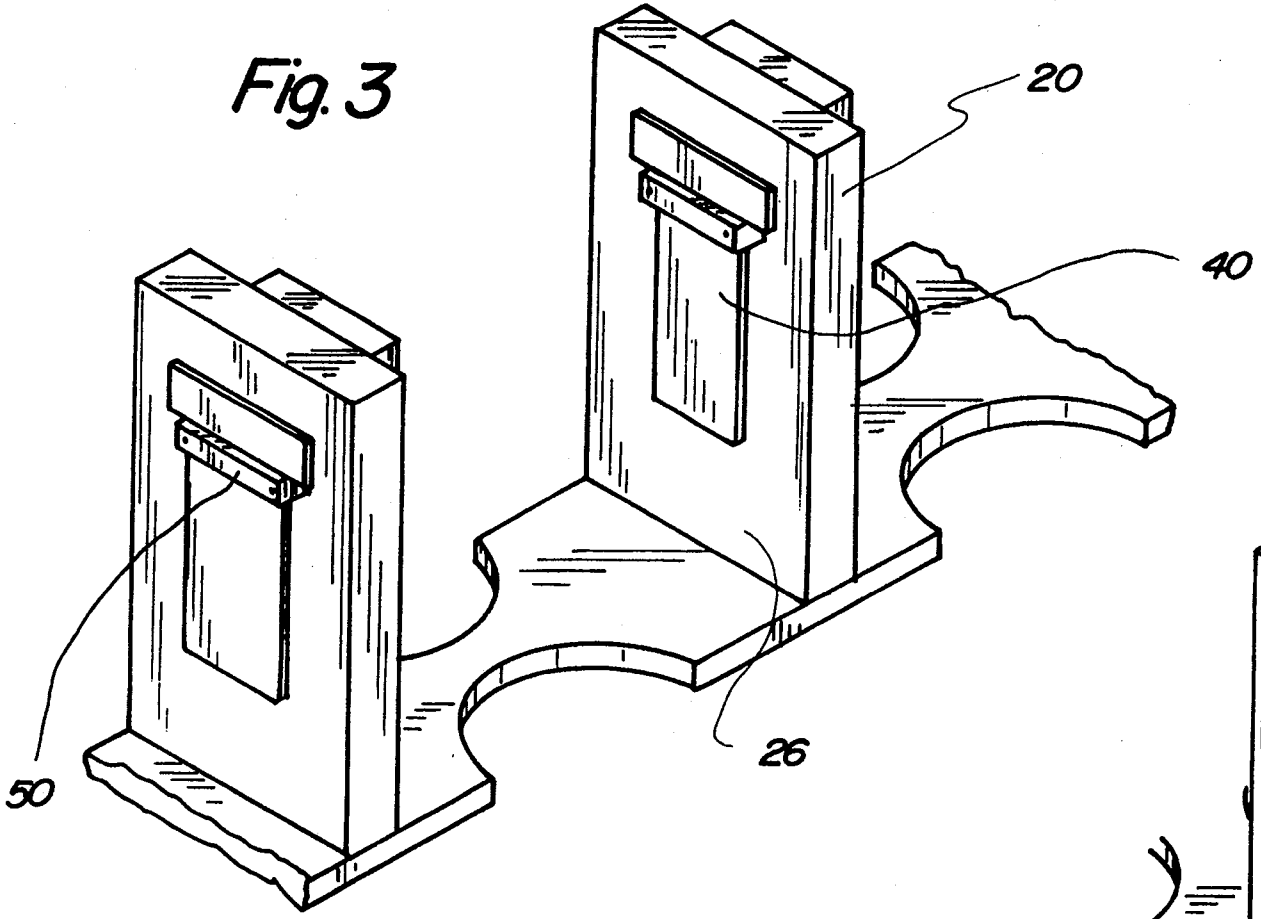
FIG. 3 is a perspective view of several tiles arranged in a linear configuration on the strap each having note bars and striker bars coupled thereto.

With reference now to the drawings, and in particular, to FIG. 1 thereof, the preferred embodiment of the new and improved toppling tone-producing toy apparatus embodying the principles and concepts of the present invention and generally designated by the reference number 10 will be described.

Specifically, the present invention includes six major components. The major components are the belt, the tiles, the striker bars, the note bars, coupling means, and hinges. These components are interrelated to provide the intended function.

More specifically, it will be noted in the various Figures that the first major component is the belt 12. The belt is fashioned of flexible material and has an upper surface 14 and a lower surface 16. The belt includes a plurality of spaced and opposed semi-circular cut-out pairs 18 formed thereon. These cut-out pairs serve two purposes. First of all, they are used to increase the flexibility of the belt. Secondly, they are used to embellish the belt with surface ornamentation. Other surface ornamentation may be disposed on the belt to enhance its appearance, such as triangles or stars.

The second major component is a plurality of rectangular tiles 20. Each tile has an upper edge 22 and a lower edge 24. In a rest configuration, each tile sits on its lower edge with the upper edge facing upwards. Each tile also has a front face 26 and a back face 28. In a rest position, the faces of the tiles are positioned in an essentially perpendicular manner relative to a horizontal plane.

The third major component is a plurality of striker bars 30. Each striker bar is coupled to the back face 28 of a tile near the upper edge 22. Each striker bar can be fashioned of rigid materials having different weights, whereby offsetting the center of gravity of each tile, thus modifying the striking force that each tile can apply when toppled.

The fourth major component is a plurality of T-shaped note bars 40. Each note bar is generally planar in configuration and is made of rigid materials. Each note bar produces a tone when struck by a striker bar. Each note bar can fashioned with a different length and weight to whereby create a different musical tone when struck.

The fifth major component is a coupling means 50. The coupling means is used to couple each T-shaped note bar to a tile. The coupling means is positioned to allow the note bar 40 to produce a tone when struck by a striker bar 30 on another tile. The coupling means on each tile is constructed to allow note bars to be interchangeable therein such that note bars coupled to tiles in a given sequence can produce a tune.

The sixth major component is a plurality of hinges 60. Each hinge is coupled to the lower edge 24 of each tile and to the upper surface 14 of the belt. Each hinge allows pivotal movement of each tile with respect to the belt. Coupling the plurality of tiles onto the belt creates an essentially linear configuration where the front faces of the tiles are directionally aligned. Each tile is also offset from adjacent tiles by a distance less than its height. When a tile is toppled towards an adjacent tile, its striker bar contacts the note bar of the adjacent tile. This causes the adjacent tile to topple, producing a tone, and creating a toppling effect that ripples through the remainder of the configuration. This has the effect of producing a plurality of tones from the note bars of subsequent toppling tiles. The present invention does not require any external power means other than gravity for toppling the subsequent tiles.

Figure 6:
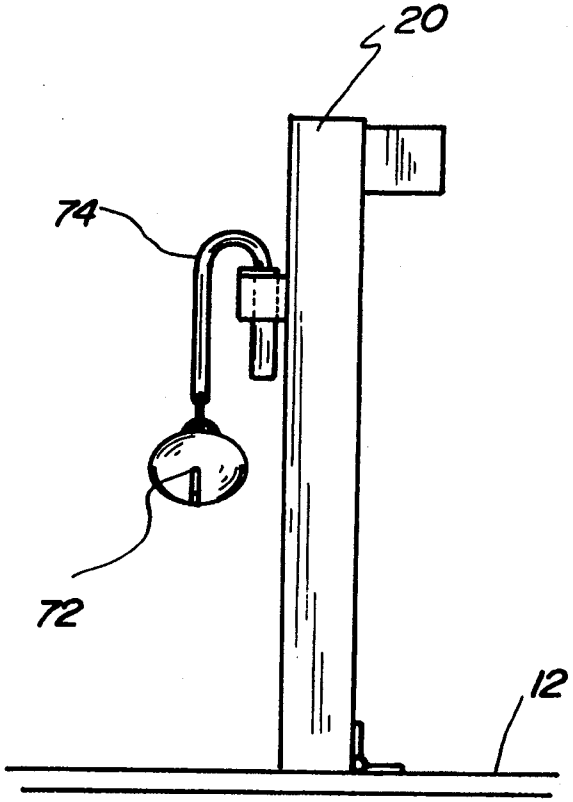
FIG. 6 is a side view of an alternate embodiment of the present invention depicting the coupling between the belt, hinge, striker bar, and tile.
Figure 5:
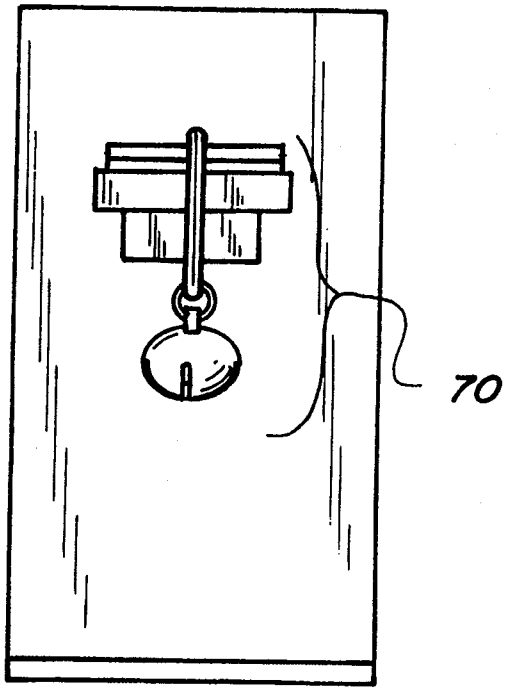
FIG. 5 depicts an alternate embodiment of the invention with the note bar having a jingle bell coupled thereto.

A second embodiment of the present invention is shown in FIGS. 5 and 6 and includes a different kind of device for producing a tone. The device used for producing a tone in this configuration is a jingle bell 70. The jingle bell has a bell 72 coupled to one end of an extended support post 74. The other end of the support post is coupled to the tile. This embodiment enables the apparatus to produce a plurality of jingling tones when the tiles are toppled, and each individual bell can ring several times as it topples onto the belt.

In the preferred embodiment of the invention, the tiles are about 2½ inches in height by 1½ inches in width and about ¼ of an inch thick. They number about 30 or so, enough to compose a small tune. The tiles can be made of wood, plastic, pressboard, or any other suitable material. The belt can be made of leather, plastic, or any other flexible material. The belt can be fabricated using both thick and thin configurations based upon the flexibility desired. The striker bars are made of metal and can be fashioned with different sizes and weights, thus producing tones having different amplitudes and pitches. The note bars are made of metal. They are sized of different lengths to correspond to different musical tones. The hinges can be fabricated from plastic or metal. The hinges are held between the belt and tile with screws, nails, or glue.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A toppling tone-producing toy apparatus for producing a plurality of tones comprising, in combination:

a plurality of tiles, each tile having a front face, a back face, and a peripheral edge;

a plurality of striker bars, each striker bar coupled to the back face of a tile;

note means coupled to the front face of each tile for producing a tone when struck by a striker bar on an adjacent tile;

support means for holding the tiles thereon; and a plurality of hinges, each hinge coupling the peripheral edge of each tile to the support means for allowing pivotal movement of the tile, the coupling of the tiles with the support means creates a generally aligned configuration where the front faces of the tiles are directionally aligned and each tile is offset from adjacent tiles by a distance less than its height such that when a tile is toppled towards an adjacent tile, its striker bar contacts the note means of the adjacent tile, whereby toppling the adjacent tile, produces a tone, and creates a toppling effect that ripples through the remainder of the configuration, thereby producing a plurality of tones from the note bars of subsequent toppling tiles.

2. The device as set forth in claim 1 wherein the note means is a jingle bell having a bell connected to and extending from a support post coupled to the tile.

3. A toppling tone-producing toy apparatus for producing a plurality of tones comprising, in combination:

a flexible belt having an upper surface, a lower surface, and a plurality of spaced and opposed semicircular cut-out pairs formed thereon;

a plurality of rectangular tiles, each tile having an upper edge, a lower edge, a front face, and a back face;

a plurality of striker bars, each striker bar coupled to the back face of a tile near the upper edge;

a plurality of T-shaped note bars, each bar produces a tone when struck by a striker bar;

coupling means coupling each T-shaped note bar to the front face of its associated tile at a position to allow the note bar to produce a tone when struck by a striker bar on an adjacent tile; and a plurality of hinges, each hinge coupling the lower edge of each tile to the belt for allowing pivotal movement of the tile, the coupling of the tiles with the belt creates a linear configuration where the front faces of the tiles are directionally aligned and each tile is offset from adjacent tiles by a distance less than its height such that when a tile is toppled towards an adjacent tile, its striker bar contacts the note bar of the adjacent tile, whereby toppling the adjacent tile, produces a tone, and creates a toppling effect that ripples through the remainder of the configuration, thereby producing a plurality of tones from the note bars of subsequent toppling tiles.

* * * * *